US008439767B2

(12) United States Patent
Feiner

(10) Patent No.: US 8,439,767 B2
(45) Date of Patent: May 14, 2013

(54) ADJUSTABLE PENDULUM GOLF PUTTING TRAINER

(76) Inventor: Louis Joseph Feiner, Carlsbad, CA (US)

( * ) Notice: Subject to any disclaimer, the term of this patent is extended or adjusted under 35 U.S.C. 154(b) by 0 days.

(21) Appl. No.: 13/065,451

(22) Filed: Mar. 23, 2011

(65) Prior Publication Data

US 2012/0244955 A1 Sep. 27, 2012

(51) Int. Cl.
*A63B 69/36* (2006.01)

(52) U.S. Cl.
USPC ..... 473/261; 473/257

(58) Field of Classification Search ..... 473/180, 473/185, 219, 226, 229, 257, 258, 265, 266
See application file for complete search history.

(56) References Cited

U.S. PATENT DOCUMENTS 3,424,464 A * 1/1969 Greenhouse ..... 473/180
3,829,091 A * 8/1974 Conrad ..... 473/131
4,655,460 A * 4/1987 Hambright ..... 473/143
4,906,606 A * 3/1990 Yamauchi ..... 503/227
6,241,621 B1 * 6/2001 Maher ..... 473/185
6,358,156 B1 * 3/2002 Moran ..... 473/219
6,846,244 B1 * 1/2005 Davis ..... 473/208
7,320,647 B2 * 1/2008 Murray ..... 473/296
2002/0165037 A1 * 11/2002 Stitz ..... 473/257

* cited by examiner

*Primary Examiner* — Nini Legesse

(57) ABSTRACT

A swinging mechanism and a ball capturing target, used together or separately, teach putting skills and enable entertaining indoor/outdoor putting games and practice. The swinging mechanism teaches tempo, direction and distance control. The mechanism adjusts to fit most bodies and putters to achieve a repeatable eye-over-ball setup. The putter-head's backside pushes the mechanism aft and lets the mechanism pace the forward stroke. Premature head and sternum movement are eliminated by focusing on swing-thought words on the base; feeling the support rod against your sternum; and noticing the mechanism tap your cheek at the instant you see and hear the putter-ball impact. Colored ball-sets are putted through 3 different sized openings into separated capture zones to score 1, 2, or 3 points per ball. Player's uniquely colored ball-sets enable easy counting and strategy changes as games progress. After final score count, up to 75 balls are easily retrieved for a new round.

2 Claims, 7 Drawing Sheets

Adjustable Golf Putting Trainer/Game

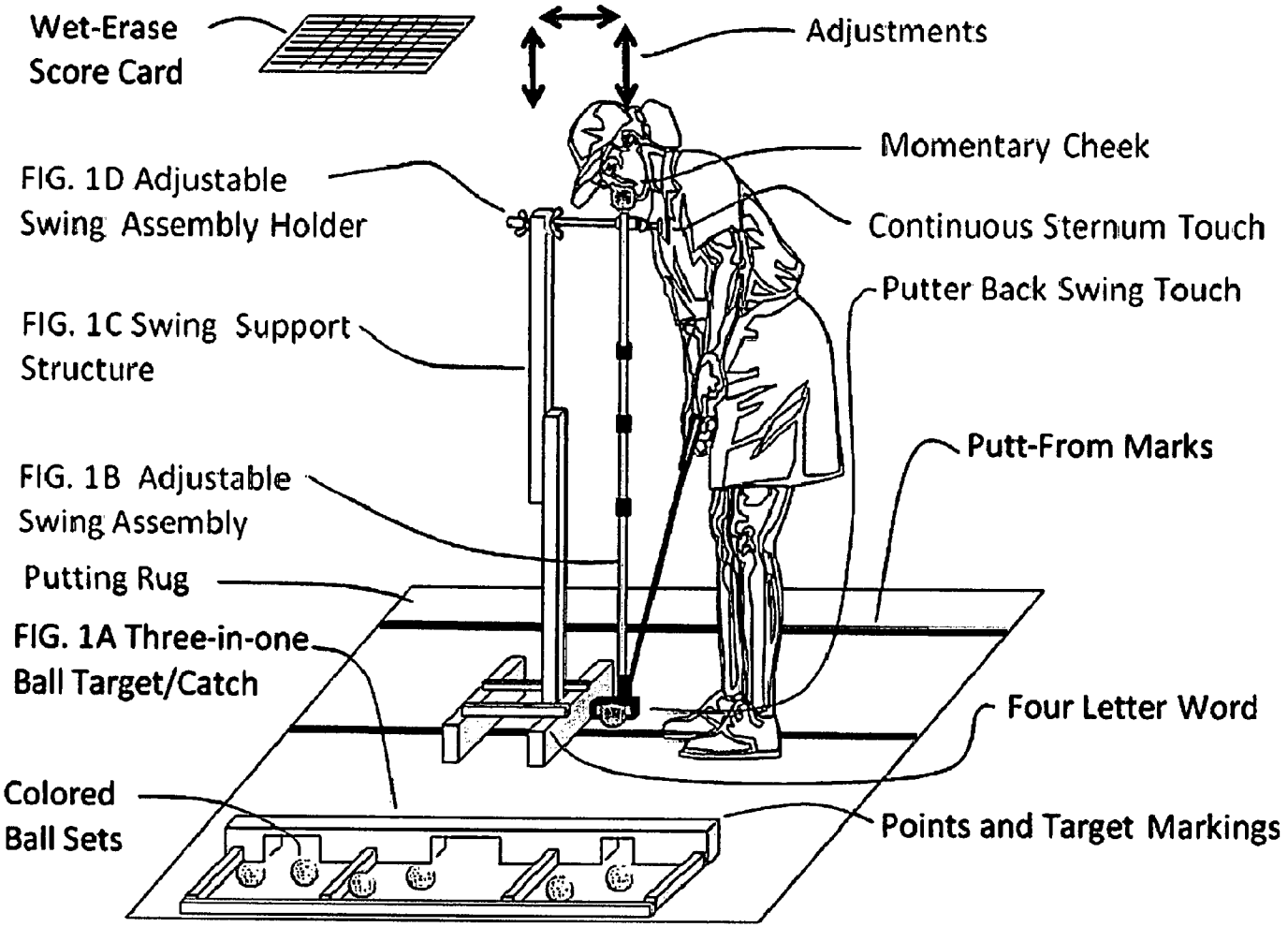
FIG. 1 Adjustable Golf Putting Trainer/Game

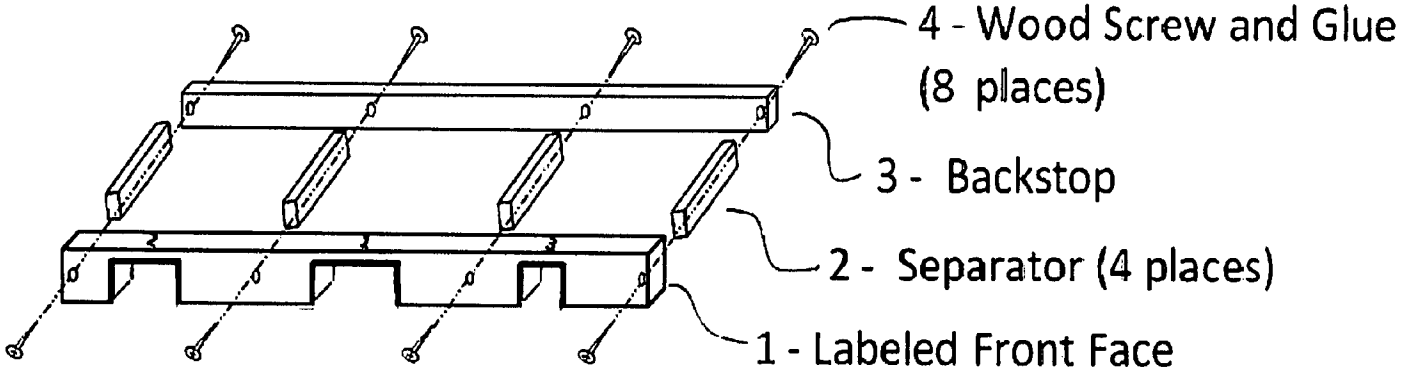
FIG. 1A Three-in-one Golf Ball Target/Catcher

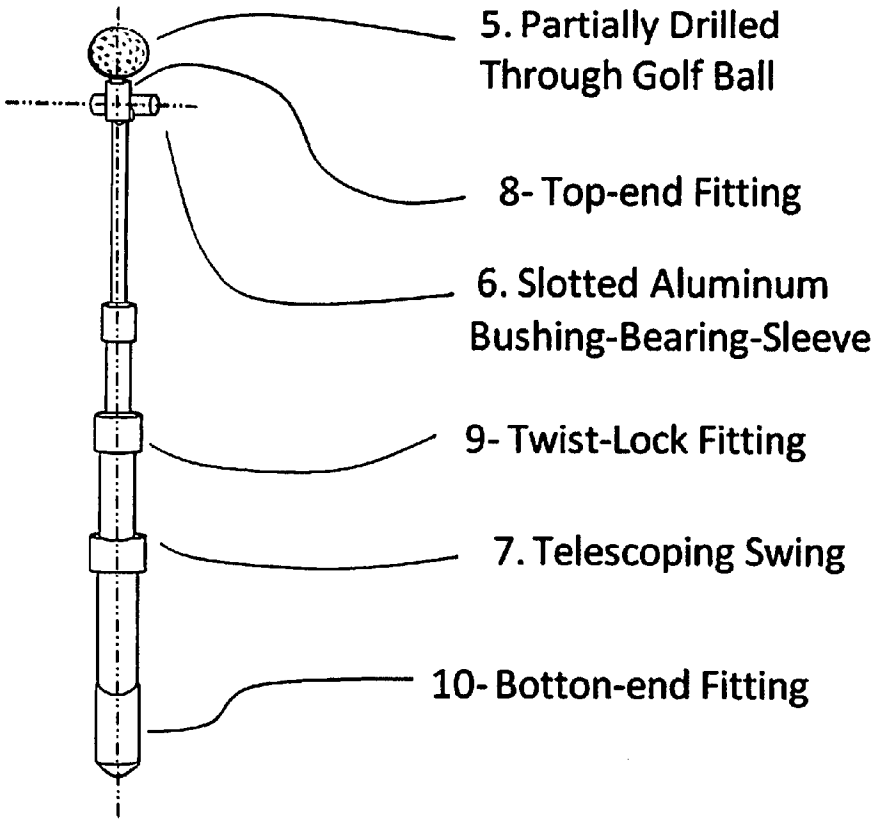
FIG. 1B Adustable Swing Assembly

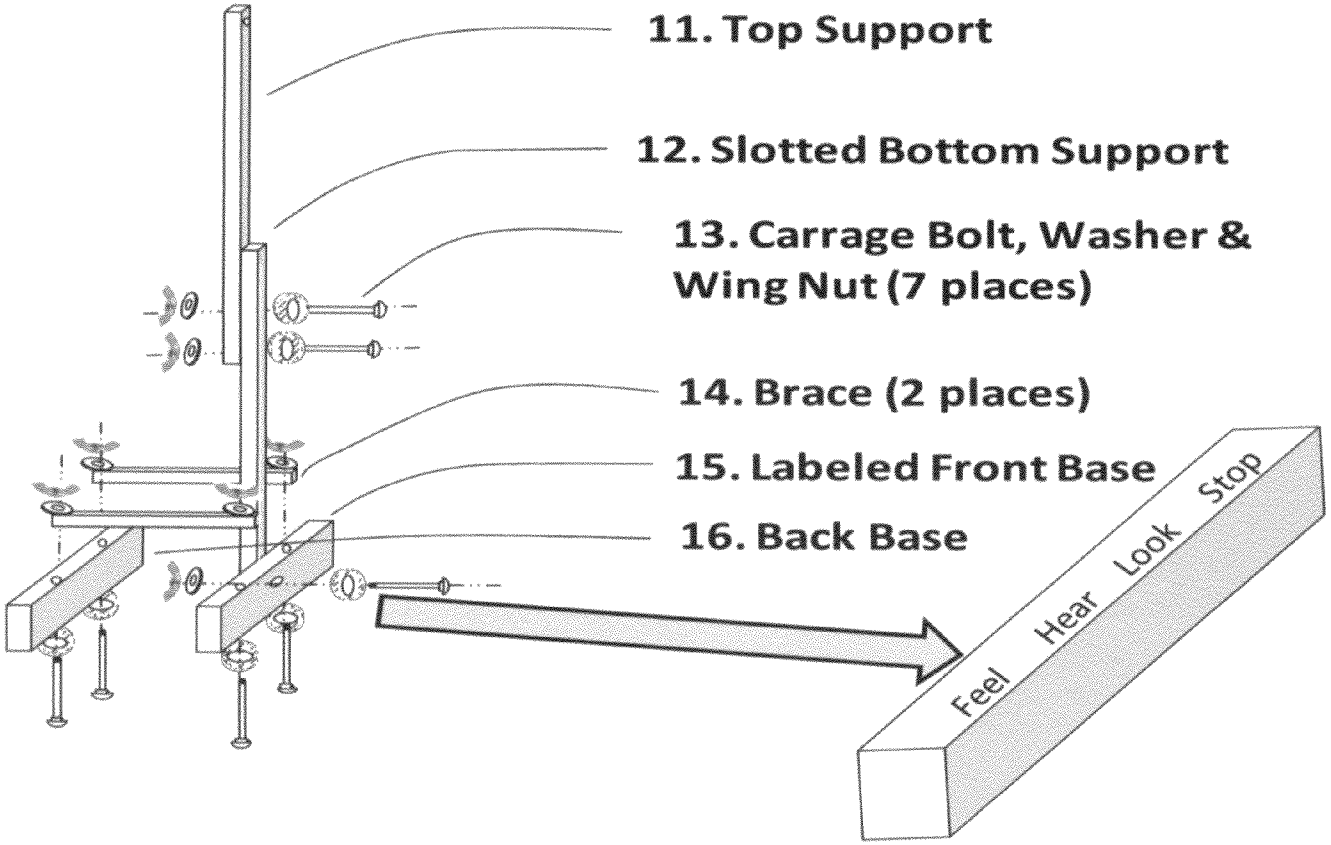
FIG. 1C Labeled Swing Support Structure and Base Assembly

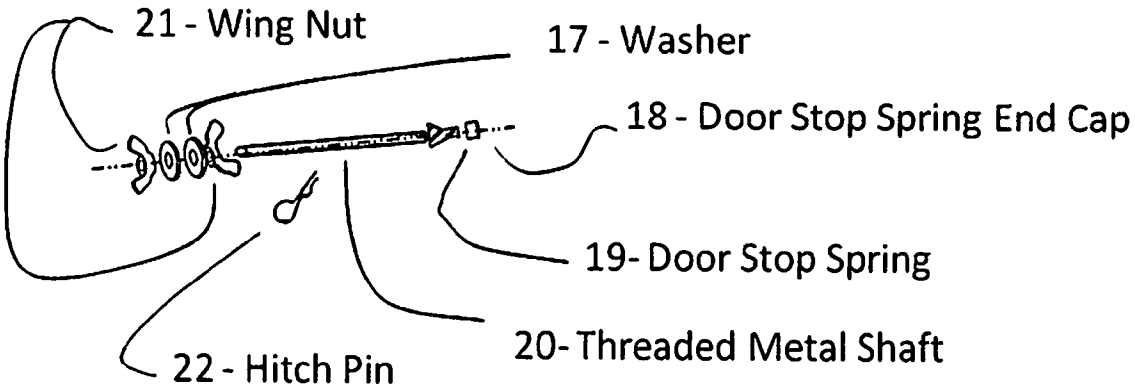
FIG. 1D Adjustable Swing Holder

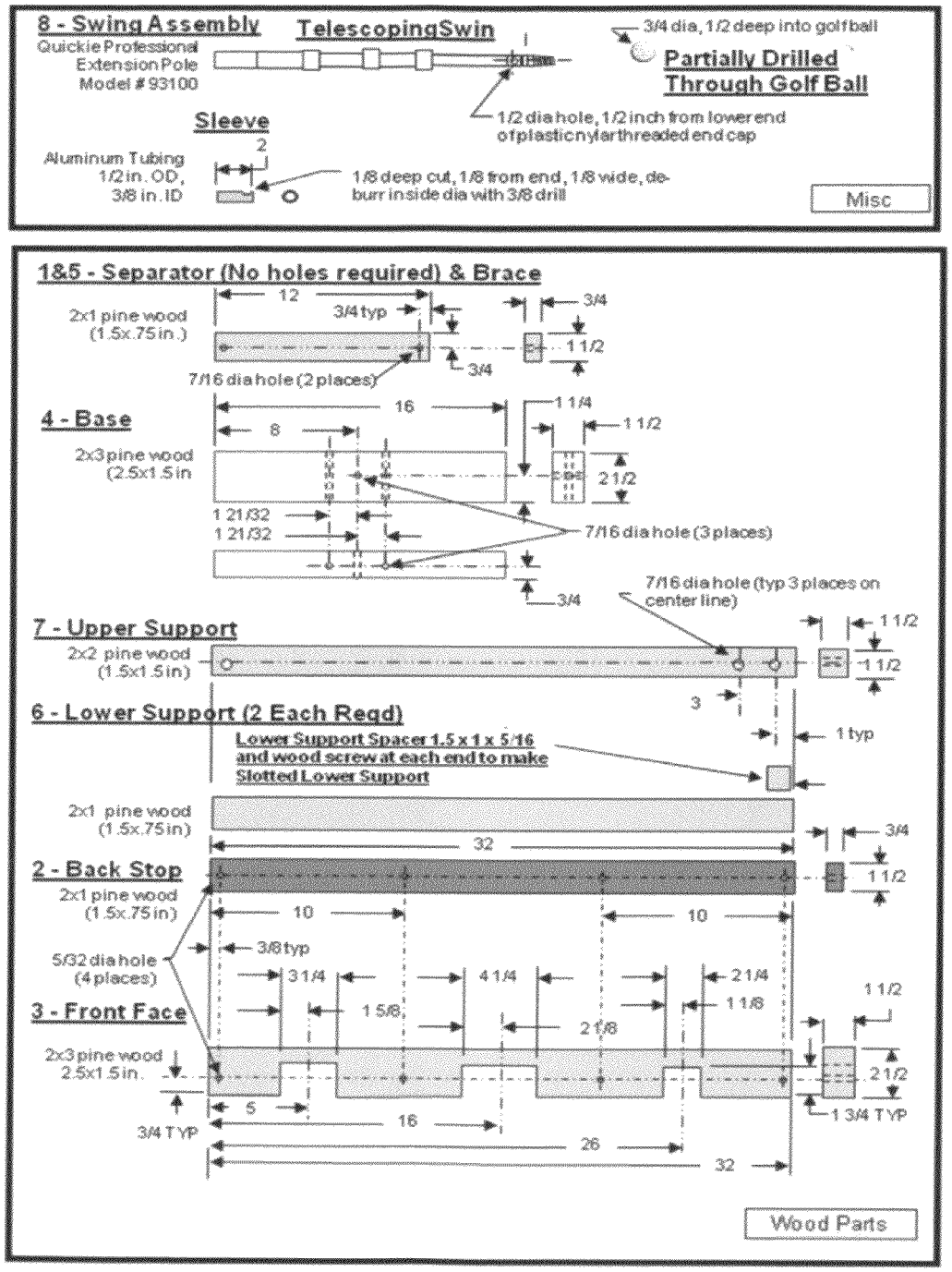
FIG. 2 - Adjustable Pendulum Golf Putting Trainer Design
1. All dimensions are in inches.
2. All edges are sanded to remove sharp corners.

| Item | Qty or Brd Ft/Unit | Description |
|---|---|---|
| | 4 | 2 1/2 inch dryw all screw |
| | 4 | 2 inch dryw all screw |
| | 2 | 1 5/8 inch dryw all screw |
| 3/8 hitch pin | 1 | Clip lock to hold sw ing |
| | 2 | 3/8 w ing nut coarse thread |
| | 7 | 1/4 hex nut |
| | 7 | 1/4 cut w asher |
| | 2 | 3/8 fender w asher |
| | 1 | 3/8 x 12in coarse thread rod |
| | 7 | 1/4 x 3 1/2 inch carriage bolt |
| Carpet | 1 | 6x9 ft (54 sq ft) |
| Al Tubing | 0.16667 | Aluminum tubing 1/2 inch O.D. x 3/8 inch I.D. |
| | 1 | Spring Doorstop PN 478 228 16, Home Depot |
| | 7 | 5/16 Lock w asher(external tooth) |
| | | |
| | 1 | Quickie Professional 2ft to 5 ft Extension Pole Mod #93100 |
| 2 x 2 pine | 5 | Unfinished pine w ood. |
| 2 x 3 pine | 5.33333 | Unfinished pine w ood. |
| 2 x 1 pine | 8.66667 | Unfinished pine w ood. |
| Duct Tape | | Yellow Duct Tape |
| Stain | | stain - estimate |
| | 1 | Golf ball |

FIG. 3 Adjustable Golf Putting Trainer/Game Materials & Parts

ADJUSTABLE PENDULUM GOLF PUTTING TRAINER

BACKGROUND

Most individuals that play golf understand how the "yips" can ruin a putt but are less aware that the same swing flaw ruins may other golf shots. The "yip" is essentially a sudden, premature, undisciplined, fast throwing of the club, upper body and head toward the static golf ball. Good swing discipline requires having awareness and control over head and sternum's steadiness as they relate to the rotation axis of the golf swing.

Many teaching devices use body or club attachments to help learn a putting stroke which makes it difficult to quickly transition from practice to live unobstructed putting. The training routines included with the adjustable golf putting trainer/game (FIG. 1) eliminate the "yips" as well as help golfers at all skill levels to quickly transition swing thoughts from the trainer to the putting surface since simply stepping back and fourth from the trainer engages and disengages the golfer and the trainer.

Golfers of all skill levels can quickly learn and perfect a putting style that replicates a gravity-accelerated downward swing. Individuals having an established putting style can also use the adjustable golf putting trainer/game (FIG. 1) to improve putting performance.

The adjustable golf putting trainer/game (FIG. 1), enables separating the mechanics of a putting swing into several pieces that can be individually practiced and perfected without the need to putt a ball. For example, practicing the tempo and travel path for a putter can be accomplished by emulating with a putter the motion of a swing as it oscillates back and forth until it decelerates to rest. None of the referenced prior art listed in Table 1 use the approach of separating putting into several physical segments and then using a device to enable putting training routines tailored to each of the physical segments.

FIG. 1B, FIG. 1C, and FIG. 1D show details of three dependent elements, the adjustable swing assembly (FIG. 1B), the adjustable swing assembly holder (FIG. 1D) and the labeled swing support structure and base (FIG. 1C). The three-in-one ball target/catch (FIG. 1A) is an independent element of the adjustable golf putting trainer/game (FIG. 1). The three-in-one ball target/catch (FIG. 1A) is used for putting practice and putting games with or without the other elements of the adjustable swing assembly swing putting trainer (FIG. 1). The three-in-one ball target/catch (FIG. 1A) enables games that can be played by individuals or competitive groups inside or outside. The games can be played almost anywhere such as at home, at school or in public locations for family gatherings, fundraisers or mild senior exercising. The adjustable golf putting trainer (FIG. 1) has adjustments for accommodating differing body sizes and putting postures.

Some putting trainers provide delayed feedback such as video or computer data, by measuring, analyzing and correlating result with actions that lead to the results. A key benefit of the adjustable golf putting trainer (FIG. 1) is that it records nothing but gives real time corrective feedback by using sight, sound and feel to recognize whether or not the natural gravity based swing of the putter is present. Additional putting training benefits are a repeatable body setup, correct body alignment, targeted swing direction, smooth swing tempo and proper ball travel distance. Training and gaming activities do not require attaching the putter to any other object as is done by many of the listed prior art. The individual may use their own putter whether they are right or left handed.

Putting games and contests are as much a part of the golfer's world as the rest of the game and require some form of scoring. Game scoring as the progresses is made easy by the three-in-one ball target/catch (FIG. 1A) and can be done during and at the end of each game. The three-in-one ball target/catch (FIG. 1A) has three different sized cutouts, 4¼, 3¼ and 2¼ inches wide all 1.75 inches high. The cutouts have a highlighting boarder and center identifier to enable the individual to visualize the target. Handicapping a game can be done by changing the putting distance to the ball catch, selecting alternate target sizes or allowing certain individuals to use the adjustable golfing putting trainer during the game. Clearly identifying each player's golf ball set, enables individual scores to be totaled as 0, 1, 2, or 3 points for each ball depending upon the ball's final location in the three-in-one ball target/catch. A nine-ball, eighteen-ball or any other ball quantity game may be agreed upon for group games. For example, a perfect nine-ball game is worth 27 points; a perfect twelve-ball game is worth 36 points.

BACKGROUND

Prior Art

Twenty five prior art are listed with comments in table 1. Some of the prior art shows various mechanical restraining, attaching or confining devices to control the putter or the individual's arms during the putting stroke. Some of the prior art uses electronic sensing, aiming, measuring or counting devices to provide visual or electronically displayed feedback information about the putting event. Most of the prior art devices provide performance feedback after the completion of the putting stroke rather than giving real time feedback for the conditions leading up to and including the putter-ball impact. Conditions leading to the putting event are setting body posture, squaring the lineup, measuring the putter travel in the backswing, preventing premature head and body movement, measuring tempo of the aft part of the swing. None of the listed "prior art" focus on establishing head location and body posture, using a touch monitor to teach prevention of head and chest movement or providing real time sight, sound, and feel feedback during the back half of the putting stroke.

Prior art does not describe, as this embodiment does, an overall putting training process that integrates the mind's target image with the human body's sensors (feel, sight and sound) and with the natural putting stroke of a swing. It should be noted that this embodiment does not incorporate training to help individuals read putting green shape, slope, grain, speed or other conditions encountered on a natural putting green. However, as noted later, no changes are needed to utilize the adjustable golf putting trainer (FIG. 1) on a typical grass putting green.

SUMMARY

The purpose for the adjustable golf putting trainer (FIG. 1) is to teach individuals of all ages and skill levels to learn a swing like a putting stroke and to continue to improve putting performance by following the "how to" lessons that are part of this embodiment. The "how to" lessons to be taught while using the adjustable golf putting trainer (FIG. 1) are as follows:

1) How to understand and appreciate the importance of proper body posture and positioning of the feet.
(i.e., positioning feet properly relative to the ball, keeping the eye over the ball, and bending the back appropriately)

2) How to develop swing tempo to be used for ball distance control
(i.e., practice keeping the individual's fore and aft rotation of the putter, hands, arms and shoulders synchronized with the path of a swing that is manually put into motion from various heights)
3) How to achieve and maintain correct putting direction alignment
(i.e., squaring the putter face with the target line and then maintaining that alignment throughout the individual's swing-emulating arc stroke)
4) How to eliminate all head and body movement except for the shoulder section that rotates around the proper swing rotation point.
(i.e., aligning the head, eyes and center of the upper chest using reference points that give full awareness of any unwanted movement until after the sound of the putter-ball impact)
5) How to manage the putter head's aft travel distance and height off the ground to predict ball travel distance.
(i.e., pause the putter at a chosen back swing high point, observing the high point relative to the trainer's front brace, then duplicate the swing's gravitational acceleration and velocity with the putter as they both move toward putter-ball impact. Repeat the process from differing high points and observe the ball travel distance for various high points.)
6) How to develop the ability to utilize mental target imagery.
(i.e., focus on the yellow outline and center marking of the ball target/catch opening to acquire a mind's image and then retain that mind's image until after the individual hears the feedback sound and see the putter-ball impact which also signals that the head, the eyes and sternum may move from their stabilized setup location.)

Training routines are described later that demonstrate how to incrementally practice parts of the putting swing using the adjustable golf putting trainer (FIG. 1) and then to transition an individual from practicing to real life golf putting competition.

DRAWINGS AND PART REFERENCES

Perspective drawings showing the main elements of the putting trainer are listed in Table 2 as FIGS. 1, 1A, 1B, 1C and 1D. The part reference numbers for parts associated with each individual main element are listed below their associated main element. Figures and tables are located in the appendix.

FIG. 1A, FIG. 1B, FIG. 1C, and FIG. 1D show details of the four main elements of the embodiment—the three-in-one ball target/catch (FIG. 1A), the adjustable swing assembly (FIG. 1B), the labeled swing support structure and base (FIG. 1C), and the adjustable swing assembly holder (FIG. 1D). Reference numbers 1 thru 22 refer to the individual unique parts needed to build the embodiment. Identical parts—screws, bolts with their nuts and washers and wood pieces—use identical reference numbers.

FIG. 2 discloses the dimensions for parts fabrication and modification.

FIG. 3 discloses list of materials and parts for making the Adjustable Golf Putting Trainer.

DETAILED DESCRIPTION

Four Main Elements

FIG. 1 is a perspective view of the four main elements that embody the patent application showing how they relate to each other by using a human character, a putter, golf balls, and a putting surface.

Element 1 Description—The three-in-one ball target/catch (FIG. 1A) shows the game part of the adjustable golf putting trainer (FIG. 1). A successful putt is trapped in one of the three catch areas not allowing the ball to enter adjacent catch areas and not allowing the ball to scatter out of the general area selected for playing the putting game. Unsuccessful putts that hit the wood outside of the cutouts on the labeled front face (1) generally stay nearby because of the dampening effect of the soft wooden material. The sound of the ball hitting pine wood combined with the ball's stopping distance from the pine wood give feedback for judging a ball's likely travel distance.

The three-in-one ball target/catch (FIG. 1A), is placed on a putting surface at an optional distance from the other three elements of the embodiment, FIG. 1B, FIG. 1C and FIG. 1D. After putting a quantity of balls, the three-in-one ball target/catch (FIG. 1A) can be used to drag (i.e., rake) the putted balls back to the starting point for another putting sequence. As alternatives, the three-in-one ball target/catch (FIG. 1A) can be picked up and placed on the opposite end of the designated putting surface without relocating the ball supply, or additional three-in-one ball target/catch's (FIG. 1A) can be placed at other locations on the designated putting area to provide multi-hole putting games.

Element 1 Assembly—The three-in-one ball target/catch (FIG. 1A) is assembled into a single unit by attaching the labeled front face (1) to four of the separators (2) using four wood screws (4) and glue. The stopper (3) is then fastened to the separators (2) using four wood screws (4) and glue Element 2 Description—The adjustable swing assembly (FIG. 1B) shows the adjustable swing element of the adjustable golf putting trainer/game (FIG. 1). The adjustable swing assembly (FIG. 1B) is used to train children and adults to duplicate the natural motion of a swing. The individual may use any putter model with the adjustable swing assembly (FIG. 1B). The adjustable swing assembly (FIG. 1B) mounting height and vertical length can be adjusted to accommodate an individual's height. The adjustable swing assembly (FIG. 1B) can also be slid toward and away from an individual's head and chest to accommodate differing setups and training routines.

Element 2 Assembly—The following items are press-fit into the telescoping swing (7); the nylar threaded top-end fitting (8); and the slotted aluminum bushing-bearing-sleeve and the putter head contact bottom-end-fitting (10) and the twist-lock fittings (9). The adjustable swing assembly (FIG. 1B) is assembled into a single unit by sliding the sections of the telescoping swing (7) together and locking them with the twist-lock fittings (9) and then rotating the partially drilled through golf ball (5) on to the nylar threaded top-end fitting (8)

Element 3 Description—The labeled swing support structure and base (FIG. 1C) is the weight-supporting structure for the adjustable swing assembly (FIG. 1B) and the adjustable swing assembly holder (FIG. 1D). The labeled swing support structure and base (FIG. 1C) provides a stable platform to align, support and counter balance the adjustable swing assembly (FIG. 1B) while static and in motion. The slot in the top support (11) enables an individual to vary the adjustable swing assembly holder's (FIG. 1D) height.

Element 3 Assembly—The labeled swing support structure and base (FIG. 1C) is assembled by joining the slotted bottom support (12) to the top support (11) and to the labeled front base (15) with 3 carriage bolts, washers and wing nuts (13). Two braces (14) are joined using 4 carriage bolts, washers and wing nuts (13) to the back base (16) and the labeled front base (15).

Element 4 Description—The adjustable swing assembly holder (FIG. 1D) is used to attach the adjustable swing assembly (FIG. 1B) to the labeled swing support structure and base (FIG. 1C) at height and location that enables the individual to touch their chest to the door spring end-cap (18) and their cheek to the partially drilled through golf ball (5). An individual slides the adjustable swing assembly (FIG. 1B) toward or away from themselves on the threaded metal shaft (20) to align their eyes with vertical plane of the adjustable. After eye alignment is completed, the hitch pin (22) is snapped in place against the threads of the threaded metal shaft (20) to keep it from moving.

To give a more compatible location for a particular individual, the threaded metal shaft (20) that supports the adjustable swing assembly (FIG. 1B) is moved vertically by loosening the wing nuts (21); sliding the threaded metal shaft (20) up or down; and tightening the wing nuts (21) at the new location. After the threaded metal shaft (20) location is set, the adjustable swing assembly (FIG. 1B) length is adjusted using the twist lock fittings (9). A correctly adjusted arrangement is shown in FIG. 1, the adjustable golf putting trainer/game.

Element 4 Assembly—The adjustable swing assembly holder (FIG. 1D) is assembled by firmly hand rotating the door stop spring (19) and the pressed on door stop spring end-cap (18) onto one end of the threaded metal shaft (20). The first wing nut (21) and washer (17) are installed approximately 2 inches from the other end of the threaded metal shaft (20). The second wing nut (21) and washer (17) are temporarily located near the same end of the threaded metal shaft (20). The hitch pin (22) is temporarily snapped onto the threaded metal shaft (20).

Element 2, 3 and 4 Assembly—Labeled Swing support structure and base (FIG. 1C) and adjustable swing assembly (FIG. 1B) are assembled by removing and reinstalling the temporarily located wing nut (21) and washer (17) after the threaded metal shaft (20) is inserted through the slotted aluminum bushing-bearing-sleeve (6) and into the hole in the top support (17). Final adjustments are made to accommodate each individual's posture as depicted in FIG. 1, the adjustable golf putting trainer/game, so an eye-over-over ball, a cheek touch and a sternum touch are present after the golfer's setup.

Detailed Description

Training Routines

Six training routines have been designed to separate and practice critical elements of a putting stroke. The training routines defined below give putting instructions of how to incrementally practice putter-body synchronization, tempo, timing, direction, and distance and putting to an image. The six training routines are:

1) Synchronizing Putting Stroke to the Swing

Push the swing into motion using your hand, then place your putter adjacent to the swing and practice swinging the putter until you can synchronize your putting motion exactly with the swing as it slowly comes to rest. Practice with the putter several times making 10 to 50 strokes synchronizing with the motion of the decelerating swing. While practicing, keep the putter head within ¼ to ½ inch of the swing's moving bottom tip.

2) Developing Putter Head Swing Arc Path

Adjust the swing and putter as follows:

a) Release the swing location hitch pin (22) and slide the adjustable swing assembly (FIG. 1B) toward the labeled swing support structure and base (FIG. 1C) until the swing's bottom is about one and one half inches away from the labeled front brace (15) and the swing's length is adjusted to be close to, but not touching the putting surface, and to be compatible with the backside of the putter design so the putter and swing can swing together without jamming the putter between the putting surface and swing's bottom. Some trial and error adjusting maybe necessary.

b) Place putter head in front of the swing's bottom on the putting surface with the putter's outer tip touching the labeled front base (15).

c) Make slight adjustments of the swing as necessary so the back center of the putter can push the swing aft without jamming.

d) Push the swing aft with the putter head about eight inches as the putter head follows the path of the swing's bottom and pause for two seconds and note the height relative to the top of the labeled front brace (15). After the 2 seconds, let the gravity driven down and forward motion of the swing pace the putter on the forward stroke. Pause again for two seconds at the end of the forward stroke and observe the putter position. The putter head's bottom surface should stay about ⅛ inch below the swing's bottom tip and the putter head's outer edges should stay ⅛ inch adjacent to labeled front base (15) during repeated pauses and strokes. Keep the putter and swing synchronized throughout the fore and aft putting motion while varying the stroke length from several inches up to approximately 30 inches. This training routine is difficult and will require a great deal of practice and patience before the individual becomes comfortable with the tempo and accuracy of the stroke.

3) Observing Putter-ball Impact Sound and Ball Direction

This training routine focuses on the swing plane and swing arc. To set up for this training routine, release the hitch pin and move the swing toward the vertical support until it hangs over the center line of the putter head while the putter head's outer edge is not touching either the swings bottom end or the labeled front base (15). The swing's length is now adjusted to accommodate the particular putter design being used by the individual so the rear of the putter head can freely push the swing's bottom tip aft and then stay in touch and synchronized with the swing's bottom tip without jamming as the putter controls the entire stroke of the swing. A ball is now placed about one half inch in front of the center of the putter head. Balls are now putted toward the three-in-one ball target/catch (FIG. 1A) until a consistent direction is accomplished. An opening in the three-in-one ball target/catch (FIG. 1A) is then moved in alignment with the observed direction. Training should continue until the results show improvement and understanding of the swing-emulating putting stroke. Practice putting 50 to 100 balls before moving on to the next training routine. Be sure that the shoulders rotate with the swing staying perpendicular to the swing, that the wrists maintain a constant angle with the arms and that the arms, wrists and putter all maintain a constant distance relative to the swing during the back half of the putting stroke.

4) Correlating Sight, Sound and Touch Feedback

This training routine focuses on using the senses of sight, sound and touch to provide real time feedback to learn to avoid moving the head and sternum until after putter-ball impact. The training routine uses the eyes to watch the four, four letter words (Stop, Look, Hear and Feel) during the putting stroke to control ball direction and travel distance. This routine changes the swing setup so the ball, the putter head and the swing's bottom are now far enough away from the labeled front base (15) so there can be no contact during the putting stroke. The swing's length should also be readjusted for the particular putter head design to avoid jamming during the putting stroke. These additional items should be accomplished in the setup: the cheek should touch the partially drilled through golf ball (5), the door spring end-cap (18) and the feet should be placed shoulder width apart, perpendicular to and at the same distance from the labeled front base (15). The individual must keep their head and the center of their upper chest (top of sternum) still until after the sound of the putter-ball impact is heard. The critical lesson learned with this training routine is the awareness of the motion of the partially drilled through golf ball (5), as it moves away from the touch of the check and then moves back to touch the cheek at exactly the sound of putter-ball impact, while the door spring end-cap (18) is remains steady and in continuous contact with the chest at the center point of shoulder rotation (top of sternum). Also, the individual is made to recognize that the putter continues to follow the swing tip's direction and arc as the putter and swing move aft and forward, pausing at each end and then being in contact with each other at the sound of putter-ball impact. And lastly, the individual is made to watch the length of the putting arc relative to the ball distance traveled by pausing at the end of the back swing and seeing the relative location of the swing's bottom and putter head to both the aft and forward ends of the labeled front base (15) during the putting stroke.

5) Using Target Mental Image

This training routine embodies all of the previous training routines with the addition of establishing and maintaining a mental image of the real target in their mind during the putting stroke. The individual trains themselves to capture a target image on their last look at the target. The target's center is marked by a yellow number that is retained as a mind's image of the target while the eyes focus on the ball and the putter head until after the sound of putter-ball impact is heard. This practice routine is a mind-controlling practice of putting to an imagined target until it becomes easy and repeatable.

6) Repeating Swing Putting

This final training routine embodies the prior training concepts but without any contact of the putter with the swing as golf balls are putted. The golf ball location, body posture, head and eye position and body alignment are established adjacent to the adjustable swing assembly (FIG. 1B) so the swing path does not interfere with the newly acquired putting stroke. The swing is put into motion by using the individual's hand. The individual selects a putter start location somewhere on the swing's path that represents a putting distance and then holds the putter static in this location until the swing's backward swing distance has decreased to match the static putter head position chosen by the individual to represent an expected ball travel distance.

The individual then emulates the swing's forward motion with the putter to strike the ball. The individual must remember to use the mental target image and the putter-ball sound before any movement of the head and sternum is allowed.

Conclusion—The adjustable golf putting trainer (FIG. 1) enables individuals of all ages and skill levels to improve their putting skill while enjoying the social aspects of the putting game. This embodiment is an assembly of simple materials and parts that are readily available at any large home building supply store. This embodiment is accomplished without the use any electronic counting, sensing or aiming devices, and uses no lighting or electric power source. As a result, it can be easily setup, taken down, stored or left in place for an extended period and can be used in many different locations. The putting game can be used in an area as small as 4×4 ft or as large as a gymnasium provided the ball rolling surface is acceptable. The end result from using the adjustable swing assembly swing putting trainer/game (FIG. 1) should be improved putting skills for every individual who has followed the training routines enabled by the adjustable golf putting trainer/game (FIG. 1). The putting training routines previously described are listed below:

1) Synchronizing Stroke to the Swing
2) Developing Putter Head Swing Arc
3) Observing Putter-ball Impact Sound and Ball Direction
4) Correlating Sight, Sound and Touch Feedback
5) Using Target Mental Image
6) Repeating Swing Putting

RAMIFICATIONS

Further ramifications for the embodiment are as follows:

1. Chipping Trainer—The same embodiment can be used as a chipping trainer if the individual uses the same stroke for chipping as for putting which is recommended by some golf professionals. However, some slight body position setup changes may be required to account for the differing angular relationship of the golf club heads and shafts as well as differing shaft lengths.
2. Game—Several three-in-one ball target/catches (FIG. 1A) can be arranged to create putting and chipping games similar to croquet and shuffle board. In the games, balls passing through the target cutout and coming to rest closest to backstop are the winners.
3. Non Square-Swing Stroke—Although this putting trainer is shown for learning to square the putter head and move it like a swing, a slightly off square putting motion can be used without changing the design.
4. Natural Putting Green—This trainer embodiment can be used without any modifications to teach putting on a natural putting green so the reading of putting green shape, slope, grain, speed or other conditions affecting a natural putting green become part of the training routines.
5. Adding Accessories—
   a) Change can be made to the bottom-end fitting (15) to make it into a variable weight accessory to change the weight of the swing thereby enabling individuals to vary the swing's tempo to one that is more compatible with their natural or desired tempo.
   b) Add a shoulder rotation guide on the top-end fitting (8) to enable a new training routine for teaching a shoulder rotation that emulates the swing's arc path.
6. Iron and Driver Trainer—The labeled swing support structure and base (FIG. 1C) and the adjustable swing assembly holder (FIG. 1D) can be used without the adjustable swing assembly (FIG. 1B) to provide a training routine for hitting full shots using any club. The door spring end-cap (18) would remain in contact with the chest during the back swing to help detect unwanted chest movement occurring until after club-ball impact sound. A slightly longer carriage rod may be required so the clubs clear the labeled swing support structure and base (FIG. 1C) when using a full swing.

NOVELTY AND UNOBVIOUS

Labeled Front Base—The labeling provided on the front base provides visible teaching aides that are easily transfer into real time swing thoughts that can be used with and without the trainer by simply stepping back and forth and continuing to practice putting since nothing needs to be connected and re-connected to the golfer or his putter.

Some parts are purchased and modified, others are made from purchased bulk materials and cut to the dimensions shown in FIG. 2. Fasteners are purchased in bulk. FIG. 2 and FIG. 3 are located in the appendix.

TABLE 1

Prior Art

| Item | Pat. No. | Title | Comment |
|---|---|---|---|
| 1 | 7,331,875 | Attachable sensor for putting stroke path and plane detection | Attaches to the putter shaft |
| 2 | 7,160,201 | Golf putting trainer | Holds the putter head |
| 3 | 7,134,966 | Golf putt training device and method | Uses projected light line & spot |
| 4 | 6,997,817 | Putter alignment tool for use in establishing a correct line of putting motion | Uses guide walls to confine putter |
| 5 | 6,702,690 | Golf putting trainer device | Uses light beams on matt |
| 6 | 6,540,620 | Golf putter training device incorporating processor and counter mechanism | Uses guide walls, sensors & electronics |
| 7 | D470,906 | Golf putting trainer | Uses guide walls |
| 8 | 6,146,283 | Golf putting training device | Uses electronic simulated stimp, distance |
| 9 | 6,036,608 | Golf putting and chipping training apparatus | Putt travels in adjustable slot to light target |
| 10 | 5,904,624 | Golf putter trainer | Gadget connect to putter and fore arms |
| 11 | 5,882,267 | Golf putting trainer | Adjustable sides guide putter |
| 12 | 5,658,204 | Putting training device having adjustable stroke | Holds putter in sloped plane with distance stops |
| 13 | 5,645,492 | Selectable target putting trainer | Adjustable hole size for putting target |
| 14 | 5,586,945 | Golf putting trainer | Uses taut string & adjustable rails to guide the putter |
| 15 | 5,527,041 | Golf putting trainer | Uses base with light to project line to target |
| 16 | 5,431,403 | Golf putting practice device with perfect putting surface | Simulator to develop 3 foot putts |
| 17 | 5,421,578 | Golf putting and chipping trainer and desk accessory device | Desk accessory with removable gadgets |
| 18 | 5,409,231 | Golf putting trainer | Elongated surface with ball on gauged stop |
| 19 | 5,390,926 | Practice putting green | Practice green simulator |
| 20 | 5,203,567 | Golf putting trainer | Arms touching device to position arms & shoulder |
| 21 | 5,129,653 | Golf putting trainer | Practice surface shape that returns ball |
| 22 | 5,069,455 | Golf putting trainer | Variable height with simulated surface materials |
| 23 | 4,919,433 | Golf putting trainer | Wrist motion pendulum fore arm restrained |
| 24 | 4,700,949 | Golf putting trainer | Trolley, rails and hinge plates |
| 25 | 4,634,131 | Golf putting trainer | Putter shaft on guide to follow rail |

Teaching Routines and Games—The "freely swinging putting motion" and "the power of a light touch" learned from the trainer teaches the individual to eliminate any jerkiness in the putting stroke, to gauge the back stroke travel for accurate distance and direction control, to overcome premature head and sternum movement; and the three-in-one golf ball target/catcher enables intermixing putting games or serious putting practice because no changes of equipment or equipment setup is required.

Real Time Feedback—The power of an immediate touch of the cheek, sternum and putter head along with the seeing and hearing of the putter-ball impact provide immediate feedback for the golfer rather than waiting for data from videos, electronic sensors or laser images to analyze and then try to make correction in the next swing.

DESIGN DETAILS

The dimensions for parts fabrication and modification are shown in FIG. 2 and parts and materials are shown in FIG. 3.

TABLE 2

Figures and Part Reference Numbers

FIG. 1 Adjustable Golf Putting Trainer/Game
- FIG. 1A Three Target Ball Catch
  - 1 - Labeled Front Face
  - 2 - Separator
  - 3 - Backstop
  - 4 - Wood Screw
- FIG. 1B Adjustable Swing Assembly
  - 5. Partially Drilled through Golf Ball
  - 6. Slotted Aluminum Bushing-Bearing-Sleeve
  - 7. Telescoping Swing
  - 8. Top-end Fitting
  - 9. Twist-Lock Fitting
  - 10. Botton-end Fitting
- FIG. 1C Swing Support Structure
  - 11. Top Support
  - 12. Slotted Bottom Support
  - 13. Carriage Bolt, Washer & Wing nut (7 places)

TABLE 2-continued

| Figures and Part Reference Numbers |
|---|
| 14. Brace (2 places) |
| 15. Labled Front Base |
| 16. Back Base |
| FIG. 1D Adjustable Swing Assembly Holder |
| 17. Washer |
| 18. Door Stop Spring End Cap |
| 19. Door Stop Spring |
| 20. Threaded Metal Shaft |
| 21. Wing Nut |
| 22. Hitch Pin |
| FIG. 2 Adjustable Golf Putting Trainer Design |
| FIG. 3Adjustable Golf Putting Trainer/Game Materials & Parts |

The invention claimed is:

1. A golf putting teaching mechanism having a swing assembly mounted on a support structure that provides a golfer, in a setup position, three touch point contacts that demonstrate and teach a golfer to achieve an eye-over-ball setup; a gravity based swing tempo and a sequence of swing thoughts that help overcome the greatest deficit of most golfer's; premature head and sternum movement; comprising a) a telescoping swing made with a plastic nylar threaded top-end fitting for mounting a golf ball; a plastic bottom-end fitting, rounded and loosely attached to avoid jamming when pushed back with any putter; and several telescoping tubular sections, that adjust to fit the body setup and putter design of any golfer—by twisting adjacent swing sections to unlock them; by sliding the sections to a length chosen by the golfer; and by twisting the sections in the opposite direction to relock the sections at the golfer's chosen length;

b) a partially drilled through golf ball, having a ½ inch diameter hole drilled ½ inch deep and snuggly rotated onto the telescoping swing's nylar threaded top for accomplishing an eye-over-ball setup; a momentary touch on the golfer's cheek at the start of the back swing and a momentary touch on the golfer's cheek at the instant the golfer sees and hears the putter-ball impact to teach golfers to avoid premature head and sternum movement;

c) a slotted aluminum bushing-bearing-sleeve press-fitted into a ½ inch diameter hole, drilled through the telescoping swing, ¾ inches above the bottom edge of the nylar fitting, to complete the adjustable swing assembly that slides laterally on a threaded shaft to facilitate a golfer's eye-over-ball setup:

d) a labeled swing support structure and base assembly, connected together using carriage bolts, washers and wing nuts, slotted vertically and marked with four, four letter words (Stop, Look, Hear and Feel), so that labeled swing support structure and base assembly supports and balances the swing assembly on flat surfaces and clearly displays the words—Stop, Look, Hear and Feel which the golfer memorizes and uses to trigger swing thoughts that produce a repeatable setup, swing tempo, putter head alignment, head and sternum stability, and stroke and ball travel distance;

e) a threaded metal shaft, inserted through a hole on the labeled swing support structure and base assembly that is used to clamp, support and squarely align the swing assembly with the labeled swing support structure and base assembly at a golfer's chosen height using washers and hand tightened wing nuts;

f) a door stop spring turned clockwise to snuggly attach the door stop spring's large open end onto the threaded metal shaft to make ready the door stop spring's small capped end to touch the golfer's sternum after the golfer makes personalized height, lateral position and target direction setup adjustments of the swing assembly to accomplish an eye-over-ball setup;

g) a hitch pin hand pressed into the slot on the aluminum bushing-bearing-sleeve that engages threads on the threaded metal shaft to hold the swing assembly in the lateral position selected by the golfer either for target practice or for learning to follow and synchronize the golfer's putting stroke with the free-fall gravity-controlled decay of the swing assembly after it has been put into motion by the golfer;

whereby the putting concepts, skills and swing thoughts learned through the powers of touching and seeing, are easily transferred from practice to competitive play because the process is as simple as stepping back from the golf putting teaching mechanism and continuing to repeat the learned practice stroke since there are no mechanical, electrical or electronic devices connected to the golfer or the golfer's putter; whereas stepping back and continuing to putt without interfering with the learned putting stroke is not possible with most other golf putting teaching and training mechanisms; because, they require the intermediate action of disengaging the golfer's body and/or putter from the training mechanisms.

2. A golf putting practice and game playing arrangement, consisting of a three-in-one golf ball target/catcher made of stained soft pine wood to dampen the golf ball's velocity after impact, to provide audible impact feedback that can be correlated to likely ball travel and to provide a furniture like aesthetic appearance; of a 8×5 foot flexible putting rug; of different colored ball sets, and of a re-usable wet-erase score card, which function together as a golf putting practice and game playing arrangement to enable golfers of all ages and skill levels to practice or play putting games comprising:

a) a labeled front face, 32 inches long, 2.75 inches high and 1.5 inches thick with three cutouts sized at 4.25, 3.25 and 2.25 inches wide and 1.75 inches high, each outlined on three sides with ⅜ inch wide yellow duct tape to give excellent visibility and ball impact durability and labeled on top with water proof numbering tags of 1, 2 and 3 for scoring purposes;

b) four separators, 12 inches long, 0.75 inches thick and 1.5 inches high, attached perpendicular to the labeled front face using drywall screws and glue on the side which is facing away from the golfer to create the sides for three ball capturing zones;

c) a back stop, 32 inches long, 0.75 inches thick and 1.5 inches high, attached to the second end of the separators using drywall screws and glue, to complete the three-in-one golf ball target/catcher that can be dragged on a flat surface, using the putter head, with up to 75 captured golf balls along with some of the nearby un-captured golf balls to the "putt-from-location" and able to be lifted with the putter head and returned empty to the "putt-to-location" for another putting sequence, thus avoiding the need to collect and return most of the putted golf balls individually;

d) a putting rug cut from smooth felt like green indoor/outdoor carpet; made from 100% post-consumer recycled plastic bottles; marked with several ⅜ inch wide strips of yellow duct tape to provide distance and handicapping lines; to be placed on top of an indoor or outdoor hard surface or a low profile carpet along with the three-in-one golf ball target/catcher making a pool table like 8×5 foot flexible putting arrangement;

e) colored ball sets that enable multiple players to easily and quickly distinguish each player's golf balls from other player's golf balls, for determining each players current ball locations, and for calculating each players current score so that players can modify putting strategy as competitive putting games progress;

f) a wet-erase score card laminated and marked with black horizontal and vertical lines and a header indentifying where names, progressive game scores and final game scores are entered using a wet-erase pen; and whereby golfers at all skill levels can enjoy the use of a golf putting practice and game playing arrangement that is designed for use on most indoor and outdoor surfaces, that can be quickly setup and taken down or left set up for indefinite periods, and that can be used for social activities, children's recess, happy hours, senior activities, office breaks, home fun, college dorm fun or golf practice and teaching.

* * * * *